US009119432B2

(12) United States Patent
Fleischmann

(10) Patent No.: US 9,119,432 B2
(45) Date of Patent: Sep. 1, 2015

(54) HEAD COOLING AID DEVICE

(71) Applicant: Bruce A. Fleischmann, Conneaut, OH (US)

(72) Inventor: Bruce A. Fleischmann, Conneaut, OH (US)

( * ) Notice: Subject to any disclaimer, the term of this patent is extended or adjusted under 35 U.S.C. 154(b) by 208 days.

(21) Appl. No.: 13/845,548

(22) Filed: Mar. 18, 2013

(65) Prior Publication Data

US 2013/0263358 A1 Oct. 10, 2013

Related U.S. Application Data

(60) Provisional application No. 61/621,030, filed on Apr. 6, 2012.

(51) Int. Cl.
*A42B 1/00* (2006.01)

(52) U.S. Cl.
CPC ..... *A42B 1/008* (2013.01)

(58) Field of Classification Search
CPC ..... A42C 5/02; A42C 5/04; A41D 20/00; A42B 1/008
USPC ..... 2/181, 183, 181.6, 181.8, 182.1–182.3, 2/0.5–0.7, 182.8, 184.5
See application file for complete search history.

(56) References Cited

U.S. PATENT DOCUMENTS

| | | | | | |
|---|---|---|---|---|---|
| 2,417,616 | A * | 3/1947 | Ryniker | ..... | 2/181.8 |
| 2,421,633 | A * | 6/1947 | Lyon | ..... | 2/7 |
| 2,442,816 | A * | 6/1948 | Knoble, Sr. | ..... | 2/173.5 |
| 5,855,023 | A * | 1/1999 | Clingenpeel et al. | ..... | 2/7 |
| 5,926,849 | A * | 7/1999 | Boyle | ..... | 2/181.8 |
| 6,199,214 | B1 * | 3/2001 | Campbell | ..... | 2/181.6 |
| 2009/0241240 | A1 * | 10/2009 | Han | ..... | 2/182.8 |

* cited by examiner

*Primary Examiner* — Katherine Moran
(74) *Attorney, Agent, or Firm* — Renner, Otto, Boisselle & Sklar, LLP

(57) ABSTRACT

Head cooling aid device comprises a strip of flexible material having a series of laterally spaced air flow passageways extending completely through the width of the strip for allowing air to flow through the passageways. At the approximate center of the length of the device is an inwardly facing recess or cavity that substantially spans the space between the wearer's eyes to avoid the pinching-off of blood flow to the wearer's head in this region caused by tight cap headbands resulting in poor blood circulation in this region that may cause over-heating of the head and/or excess sweating. The device can either be attached to an inner surface of a front portion of a cap headband or be made an integral part of the front portion of the cap headband to promote air flow into the cap through the passageways and out through top vents in the cap when worn to contribute to cooling of the top of the wearer's head.

6 Claims, 5 Drawing Sheets

HEAD COOLING AID DEVICE

CROSS-REFERENCE TO RELATED APPLICATIONS

This application claims the benefit of U.S. Provisional Application Ser. No. 61/621,030, filed Apr. 6, 2012, the entire disclosure of which is incorporated herein by reference.

FIELD OF THE INVENTION

This invention relates to a head cooling aid device that is incorporated into the headband of a cap, hat or helmet to aid in cooling the wearer's head.

SUMMARY OF THE INVENTION

The head cooling aid device of the present invention extends along the inside of the headband of a cap, hat or helmet (hereafter collectively referred to as a "cap"), spanning across substantially the full breadth of the wearer's forehead just above the wearer's eyebrows. At the approximate center of the length of the device is an inwardly facing recess or cavity that substantially spans the space between the wearer's eyes to eliminate the pressure that might otherwise be applied to the wearer's forehead in this area by a tight cap headband so as not to impede the natural flow of blood upwards through the main arteries leading from the approximate center of the wearer's eyes/nose area up to the top of the wearer's head. This avoids the pinching-off of blood flow to the wearer's head in this region caused by tight cap headbands resulting in poor blood circulation in this region that may cause over-heating of the head and/or excess sweating.

On opposite sides of the center cavity or recess are a series of laterally spaced air flow passageways extending all the way through the width of the device from top to bottom to promote air flow through the cap, which contributes to cooling of the top of the wearer's head.

DETAILED DESCRIPTION

Figure 1:
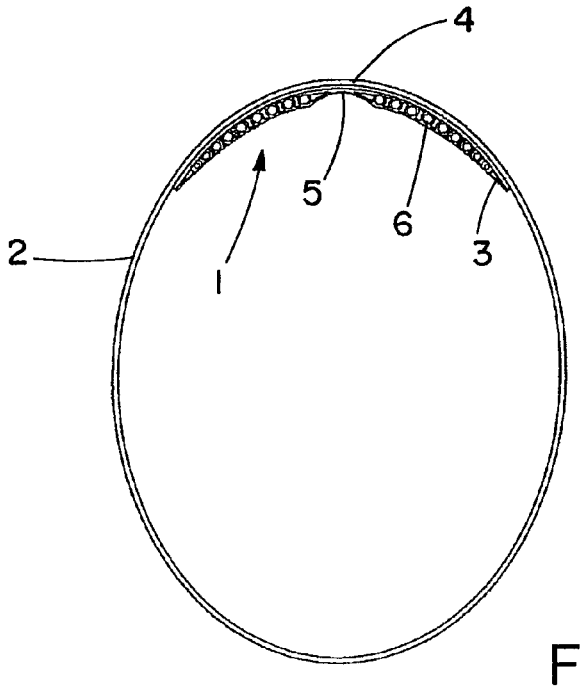
FIG. 1 is a schematic top plan view of one form of head cooling aid device shown attached to the inner surface of a headband for a cap.
Figure 2:
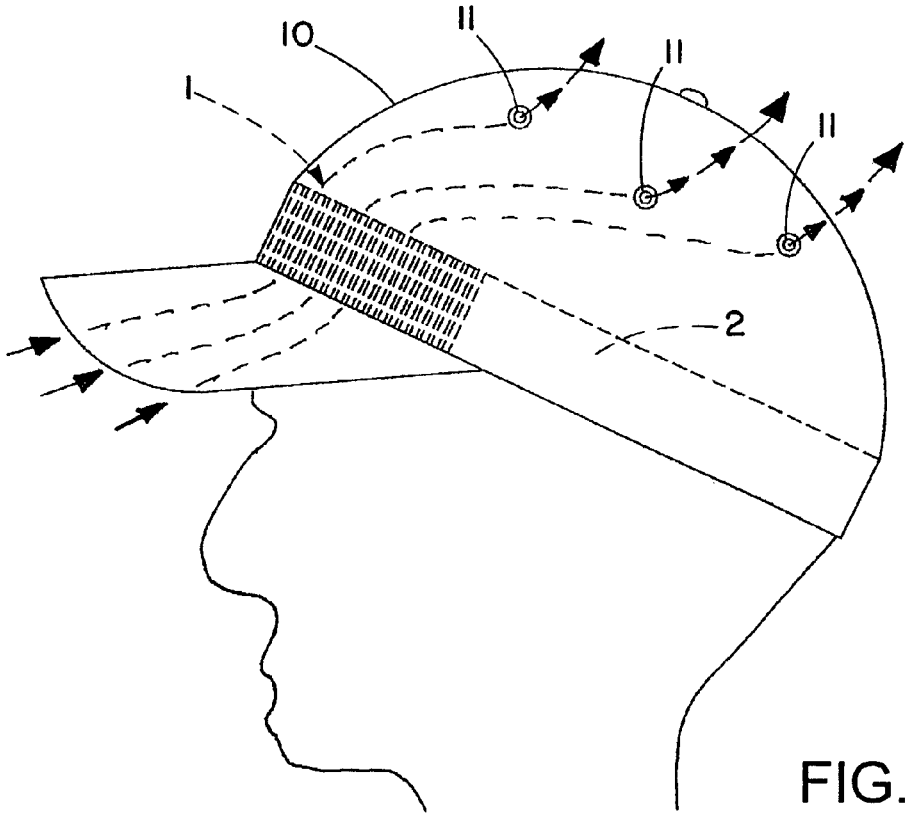
FIG. 2 is a schematic side view of the head cooling aid device and headband of FIG. 1 mounted inside a cap to show how the device promotes air flow into the cap and out through vent openings in the top of the cap when worn.

Referring now in detail to the drawings, and initially to FIGS. 1 and 2, there is shown one form of head cooling aid device 1 attached to the inner surface of a headband 2 of a cap, hat or helmet 10, including but not limited to a baseball cap, golf cap and safety helmet and the like (hereafter collectively referred to as a "cap").

Figure 3:
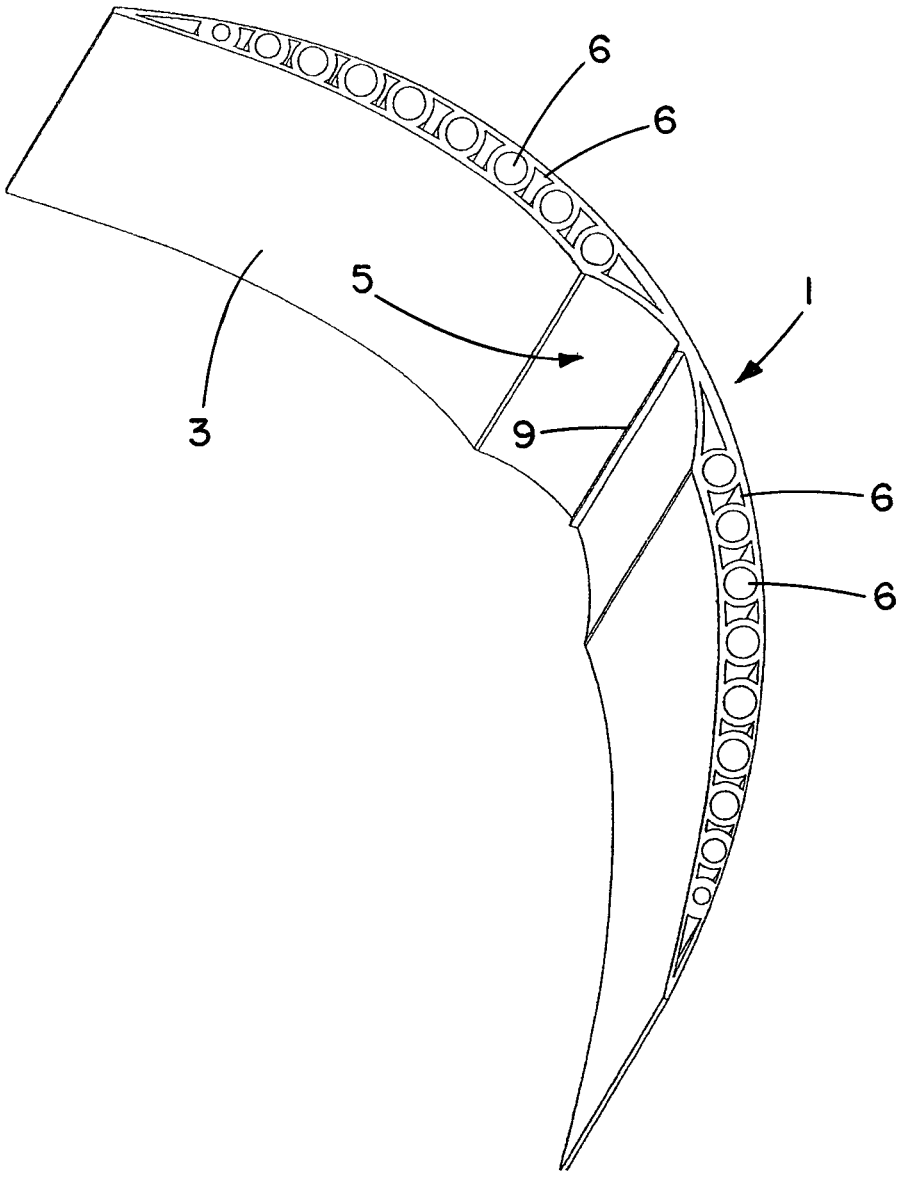
FIG. 3 is an enlarged schematic perspective view of the head cooling aid device of FIG. 1.

The head cooling aid device 1 comprises a strip 3 of flexible material having a greater length than width and a greater width than thickness, and extends along the inside of the front portion 4 of the headband 2, preferably spanning across substantially the full breadth of the wearer's forehead just above the wearer's eyebrows. As best seen in FIG. 3, at the approximate center of the length of the strip 3 is an inwardly facing concave or rounded recess or cavity 5 that spans the space between the wearer's eyes and extends the full width of the strip to eliminate the pressure that might otherwise be applied to the wearer's forehead in this region by a tight cap headband so as not to impede the natural flow of blood upwards through the main arteries leading from the approximate center of the wearer's eyes/nose area up to the top of the wearer's head. This avoids the pinching-off of blood flow caused by tight headbands resulting in poor blood circulation in this region that may cause over-heating of the head and/or excess sweating.

Extending completely through the width of the strip 3 on opposite sides of the center cavity or recess 5 are a series of laterally spaced passageways 6 that promote air flow into the cap 10 and out through vent openings 11 in the top of the cap as schematically shown in FIG. 2, which contributes to cooling of the top of the wearer's head.

The device 1 may be made separately from the headband 2 as a stand-alone product as shown in FIG. 3 (for example, by a continuous extrusion process) for the aftermarket, and attached to the inner surface of the headband in any suitable manner, for example, by using suitable fasteners 8 such as clips, staples, or hook and loop fasteners or stitching, or using double sided adhesive tape as schematically shown in FIG. 1.

Figure 5:
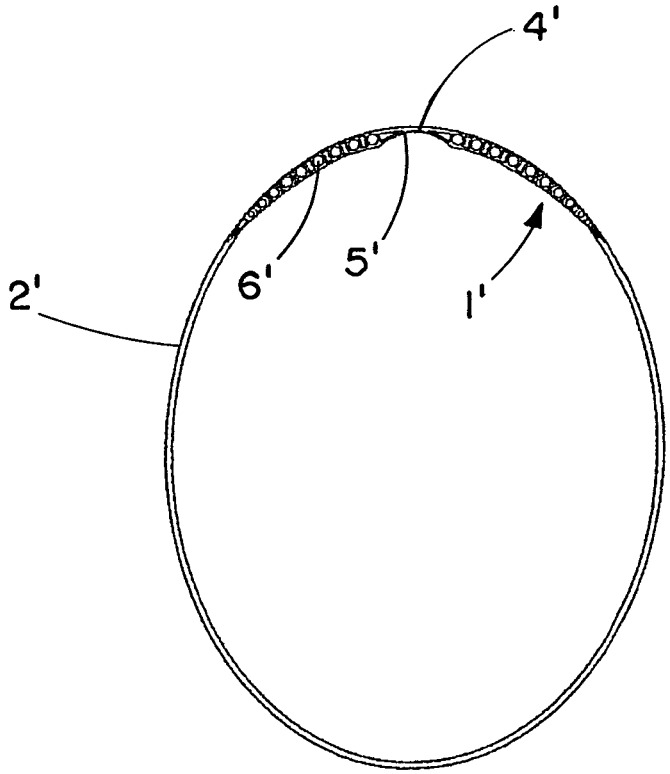
FIG. 5 is a schematic top plan view of such head cooling aid device shown formed as an integral part of the headband for a cap.

Alternatively, the device 1' may be formed as an integral part of the headband 2' as schematically shown in FIG. 5 and manufactured into the cap. In any case, the device 1, 1' is desirably made of a suitable compliant polymeric material that is sufficiently flexible to conform to the shape of the headband and forehead of the wearer but firm enough to allow the air flow passageways 6 and recess or cavity 5 in the strip to stay open during use of the device. Some exemplary flexible materials from which the strip may be made are foamed and non-foamed polyethylene and polypropylene and open-cell sponge rubber or the like.

Although the dimensions of the device may vary, by way of example, the strip may have an overall length of approximately 6 inches, a height or width of approximately 1 inch and a thickness of between approximately ⅜ inch and approximately ¼ inch with tapered end edges. Also the recess or cavity 5 may have a generally concave shape with an overall width of approximately 1 inch to approximately 1½ inches and a maximum depth of approximately 1/16 inch at the approximate center. A rib 9 may extend along the width of the strip at the approximate center of the recess or cavity 5 to provide for increased rigidity of the strip in the region of the recess or cavity.

Figure 4A:
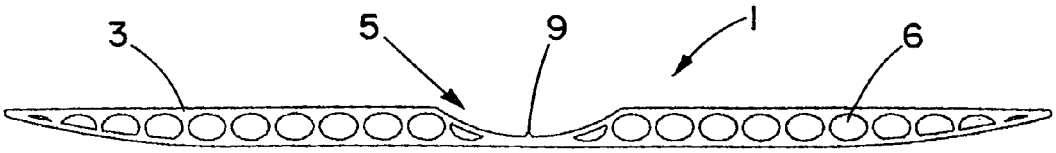
FIGS. 4A-4J are schematic top plan views of head cooling aid devices showing different shapes and sizes of air flow passageways extending through the width of the devices from top to bottom.
Figure 4B:
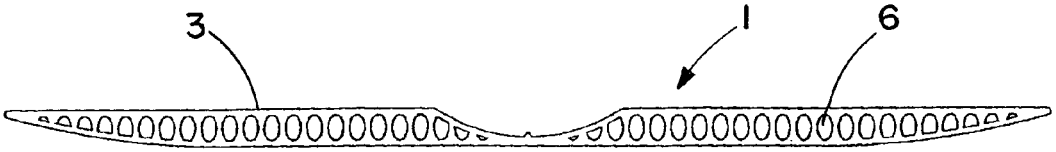
Figure 4C:
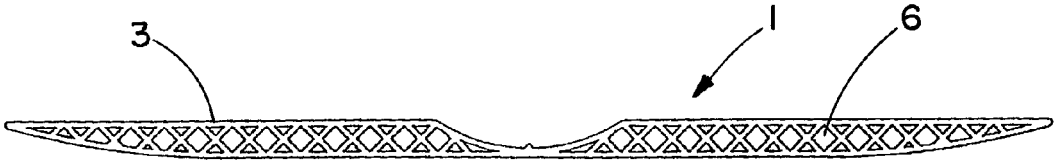
Figure 4D:
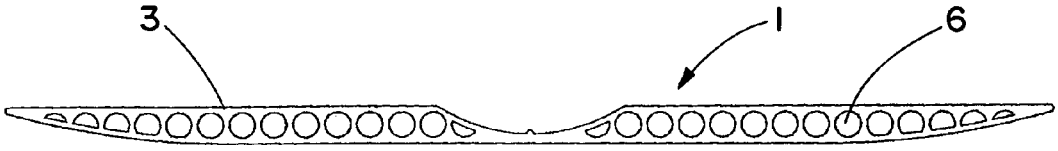
Figure 4E:
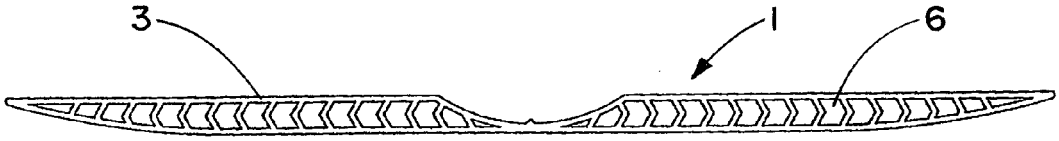
Figure 4F:
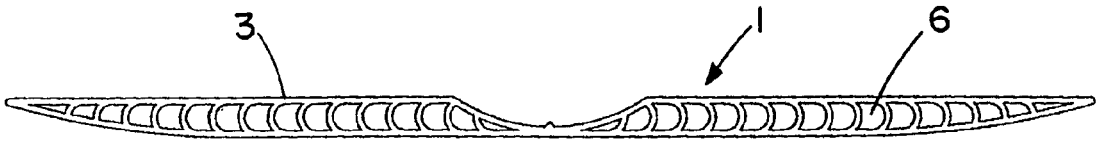
Figure 4G:
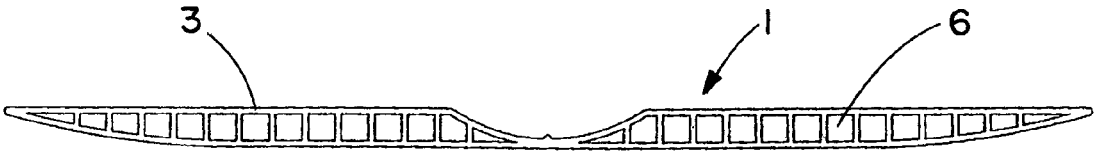
Figure 4H:
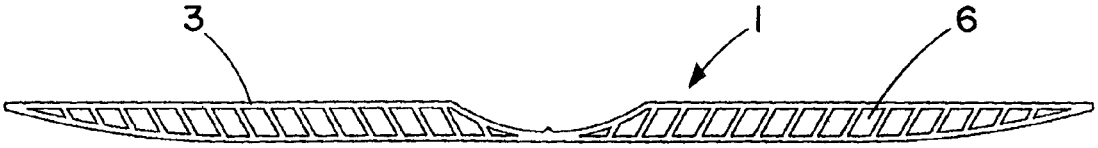
Figure 4I:
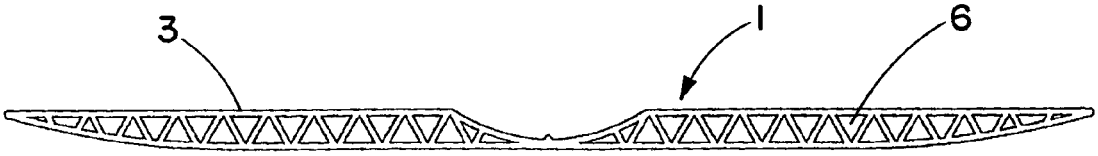
Figure 4J:
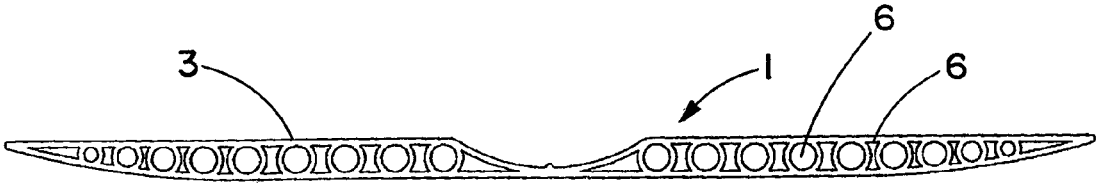

The air flow passageways 6 through the device 1 may be of different shapes and sizes including, but not limited to the longitudinal or lateral oval shapes shown in FIGS. 4A and 4B, the diamond shapes shown in FIG. 4C, the cylindrical shapes shown in FIG. 4D, the chevron shapes shown in FIG. 4E, the D-shapes shown in FIG. 4F, the rectangular shapes shown in FIG. 4G, the hexagonal shapes shown in FIG. 4H, the triangular shapes shown in FIG. 4I, and one or more combinations of different shapes as shown for example in FIG. 4J.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means" used to describe such components) are intended to correspond, unless otherwise indicated, to any component which performs the specified function of the described component (e.g., that is functionally equivalent), even though not structurally equivalent to the disclosed component which performs the function in the herein exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A head cooling aid device comprising a strip of flexible material having inner and outer wall surfaces and a greater length than width and a greater width than thickness, and a series of laterally spaced air flow passageways extending completely through the strip in a width direction of the strip for allowing air to flow through the passageways, wherein the thickness of the flexible strip progressively thins out from opposite directions toward an approximate center of the length of the strip to provide an inwardly facing cavity or recess on the inner wall surface of the strip at the approximate center of the length of the strip, and the air flow passageways are in laterally spaced relation from opposite ends of the inwardly facing cavity or recess, wherein the device is either attached to an inner surface of a front portion of a headband of a cap or is an integral part of the front portion of the headband to promote air flow into the cap through the passageways and out through top vents in the cap when worn to contribute to cooling of a top of a wearer's head, and the inwardly facing cavity or recess at the approximate center of the length of the strip spans a space between a wearer's eyes and extends the full width of the strip to eliminate pressure that might otherwise be applied to a wearer's forehead in the space between the wearer's eyes by a tight cap headband so as not to impede a natural flow of blood in the space between the wearer's eyes to the top of the wearer's head, further comprising a rib extending along the width of the strip at the approximate center of the recess or cavity to provide for increased rigidity of the strip in a region of the recess or cavity.

2. The device of claim 1 which is attached to the inner surface of the front portion of the headband of the cap to promote air flow into the cap through the passageways and out through the top vents in the cap when worn to contribute to cooling of the top of the wearer's head.

3. The device of claim 1 which is an integral part of the front portion of the headband of the cap to promote air flow into the cap through the passageways and out through the top vents in the cap when worn to contribute to cooling of the top of the wearer's head.

4. The device of claim 1 wherein the recess or cavity has a generally concave shape with an overall width of approximately 1 inch to approximately 1½ inches.

5. The device of claim 4 wherein the recess or cavity has a maximum depth of approximately 1/16 inch at the approximate center.

6. The device of claim 1 wherein the strip is made of a compliant polymeric material that is sufficiently flexible to conform to a shape of the wearer's forehead but firm enough to allow the air flow passageways to stay open when worn.

* * * * *